US010842343B2

(12) United States Patent
Batts

(10) Patent No.: US 10,842,343 B2
(45) Date of Patent: Nov. 24, 2020

(54) CLEANING TOOL WITH ADJUSTABLE TENSIONER AND RELATED METHOD

(71) Applicant: CONTEC, INC., Spartanburg, SC (US)

(72) Inventor: Donald L. Batts, Tryon, NC (US)

(73) Assignee: CONTEC INC., Spartanburg, SC (US)

( * ) Notice: Subject to any disclaimer, the term of this patent is extended or adjusted under 35 U.S.C. 154(b) by 0 days.

(21) Appl. No.: 16/433,158

(22) Filed: Jun. 6, 2019

(65) Prior Publication Data

US 2019/0374085 A1 Dec. 12, 2019

Related U.S. Application Data

(60) Provisional application No. 62/682,606, filed on Jun. 8, 2018.

(51) Int. Cl.
*A47L 13/258* (2006.01)

(52) U.S. Cl.
CPC ..... *A47L 13/258* (2013.01)

(58) Field of Classification Search
CPC ..... A47L 13/256; A47L 13/258
See application file for complete search history.

(56) References Cited

U.S. PATENT DOCUMENTS

| | | | | |
|---|---|---|---|---|
| 7,908,701 | B1 * | 3/2011 | Aiyar | A46B 11/0017 15/228 |
| 2008/0016639 | A1 * | 1/2008 | Morris | A47L 13/258 15/228 |
| 2015/0208894 | A1 * | 7/2015 | Salmon | A47L 13/253 15/147.1 |
| 2016/0256029 | A1 * | 9/2016 | Weaver | A47L 13/12 |
| 2017/0280961 | A1 * | 10/2017 | Pellegrino | A46B 5/0095 |
| 2019/0365191 | A1 * | 12/2019 | Huda | B62B 3/10 |

FOREIGN PATENT DOCUMENTS

| | | | | |
|---|---|---|---|---|
| DE | 202017104994 U1 * | 9/2017 | | A47L 13/14 |
| WO | WO-2012058812 A1 * | 5/2012 | | A47L 13/20 |

* cited by examiner

*Primary Examiner* — Marc Carlson
(74) *Attorney, Agent, or Firm* — J.M. Robertson, LLC

(57) ABSTRACT

A cleaning tool incorporating a resilient mop head having an attachment assembly extending away from the mop head for operative connection to an elongated handle structure. An adjustable force applicator is disposed in substantially coaxial relation to the elongated handle structure between the handle structure and the attachment assembly. Adjustment of the force applicator by a user permits the application of variable compressive force against the attachment assembly thereby controlling the degree of permitted mop head movement.

18 Claims, 4 Drawing Sheets

CLEANING TOOL WITH ADJUSTABLE TENSIONER AND RELATED METHOD

CROSS-REFERENCE TO RELATED APPLICATIONS

This non-provisional application claims the benefit of, and priority from, U.S. provisional application 62/682,606 having a filing date of Jun. 8, 2018 the contents of which are hereby incorporated by reference herein in their entirety.

TECHNICAL FIELD

The present disclosure relates generally to cleaning products, and more particularly to a cleaning tool incorporating a mop head operatively connected to an elongated handle with a variable compression connection such that the mop head is subject to greater control by a user.

BACKGROUND OF THE DISCLOSURE

Systems that permit mop heads to swivel relative to an elongated handle structure are well known. By way of example only, and not limitation, U.S. Pat. No. 7,574,777 to Fuller et al. which is hereby incorporated by reference in its entirety discloses a connection system for a cleaning device which facilitates a degree of relative movement between the cleaning device and a user-manipulated handle. Although such systems may be functional, the structure is such that when the mop head is lifted from the cleaning surface it tends to swivel in no defined or controlled pattern. That is, the mop head does not maintain a fixed orientation relative to the handle. When the mop head is raised away from the cleaning surface it may tend to pivot to a substantially vertical orientation by force of gravity. Thus, a user may be required to reorient the mop head each time the mop head is lifted away from the cleaning surface during use. This reorientation is typically done by pressing a corner of the mop against some surface to give it orientation and to then pressing down and sideways to re-flatten the mop face against the surface to be cleaned. This procedure is often awkward and sometimes impossible in tight quarters. Also, it takes additional effort to perform this operation which may lead to user frustration.

In light of the various noted problems associated with current mop systems, an alternative construction which eliminates such problems while providing the user with additional control would represent a useful advancement over the current art.

SUMMARY

The present disclosure offers advantages and alternatives over the prior art by providing a cleaning tool incorporating a resilient mop head (also referred to as a mop frame). An attachment assembly extends away from the mop head for operative connection to an elongated handle structure. An adjustable force applicator is disposed in substantially coaxial relation to the elongated handle structure between the handle structure and the attachment assembly. Adjustment of the force applicator by a user permits the application of variable compressive force against the attachment assembly thereby controlling the degree of permitted mop head movement.

In accordance with one exemplary, non-limiting aspect, the present disclosure provides a cleaning tool including a mop head operatively connected to a handle assembly. The mop head includes a connection member disposed at an upper surface of the mop head. The handle assembly includes a frame attachment assembly adapted to engage and retain the connection member. The frame attachment assembly has a substantially pyramid shape including a base portion having one or more engagement slots adapted to engage the connection member and sloped sides extending upwardly in angled relation away from the base portion and towards one another. The handle assembly further includes a handle attachment element operatively connected to one end of an elongated user manipulated handle having a length dimension. The handle attachment element includes an integral tongue portion projecting axially away from the user manipulated handle along an axis corresponding to the handle length dimension. The tongue portion is operatively connected to the frame attachment assembly at a position between the sloped sides. An adjustable force applicator is disposed circumferentially around the handle attachment element in coaxial relation to the user manipulated handle. The adjustable force applicator includes an internal threaded sleeve secured in fixed, non-rotating relation to the user manipulated handle. An external threaded sleeve is disposed in circumferential threaded relation to the internal threaded sleeve such that rotation of the external threaded sleeve causes axial movement of the external threaded sleeve relative to the internal threaded sleeve. The external threaded sleeve includes a main body portion and a nipple projecting downwardly away from the main body portion. The nipple has an outer diameter less than the main body portion to define a downwardly facing circumferential shoulder. A free-floating pivot sleeve is disposed in circumferentially surrounding relation to a lower portion of the external threaded sleeve. The pivot sleeve includes a pivot sleeve body and a reduced diameter coaxial pivot sleeve nipple projecting downwardly away from the pivot sleeve body. The pivot sleeve including a circumferential groove at the interior of the pivot sleeve and an axial opening adapted to receive an upper portion of the frame attachment assembly. A helical spring is seated between the downwardly facing circumferential shoulder of the external threaded sleeve and an opposing support surface within the circumferential groove at the interior of the pivot sleeve such that rotation of the external threaded sleeve causes adjustment to compression forces applied to the spring and the frame attachment assembly.

Figure 1:
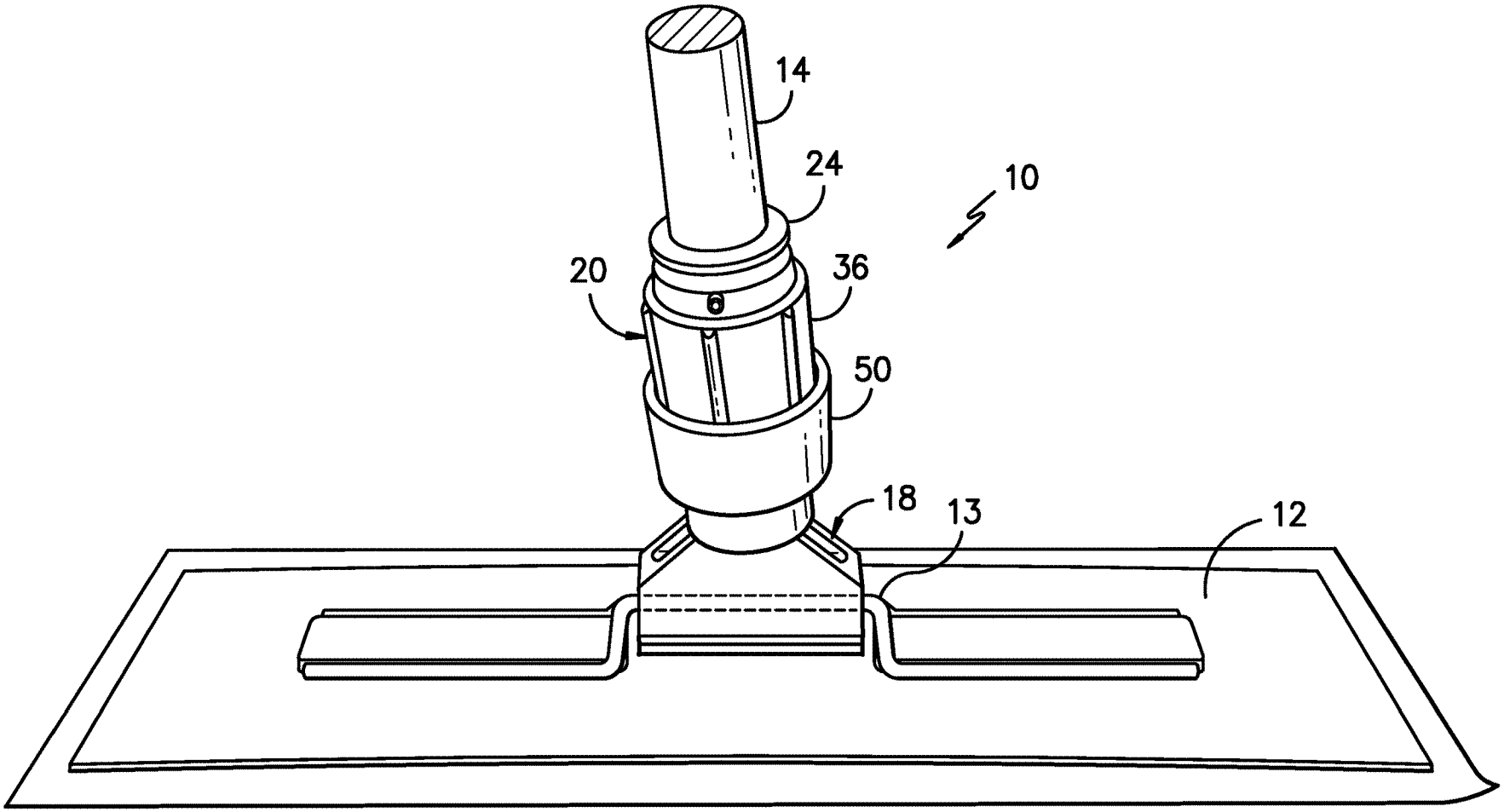
FIG. 1 is a perspective view of a mop system consistent with the present disclosure incorporating an exemplary mop frame and adjustable force applicator.

Before the exemplary embodiments of the disclosure are explained in detail, it is to be understood that the disclosure is in no way limited in its application or construction to the details and the arrangements of the components set forth in the following description or illustrated in the drawings. Rather, the disclosure is capable of other embodiments and being practiced or being carried out in various ways. Also, it is to be understood that the phraseology and terminology used herein are for purposes of description only and should not be regarded as limiting. The use herein of terms such as "including" and "comprising" and variations thereof is meant to encompass the items listed thereafter and equivalents thereof as well as additional items and equivalents thereof.

DETAILED DESCRIPTION OF THE PREFERRED EMBODIMENTS

Exemplary embodiments of the disclosure will now be described in reference to the drawings wherein like elements are designated by like reference numerals in the various views. Referring now in particular to FIG. 1, a mop system 10 consistent with the present disclosure is illustrated. In the illustrated, exemplary construction, the mop system 10 includes a mop frame 12 (also known as a mop head) including a connection member 13, an elongated handle 14, a frame attachment assembly 18 joining the mop frame 12 to the handle 14, and an adjustable force applicator 20 disposed in substantially co-axial relation to the handle and operatively engaging the frame attachment assembly. As will be described further hereinafter, adjustment of the force applicator 20 provides variable levels of compression against the frame attachment assembly 18 thereby controlling the degree of relative movement between the handle 14 and the mop frame 12.

Figure 2:
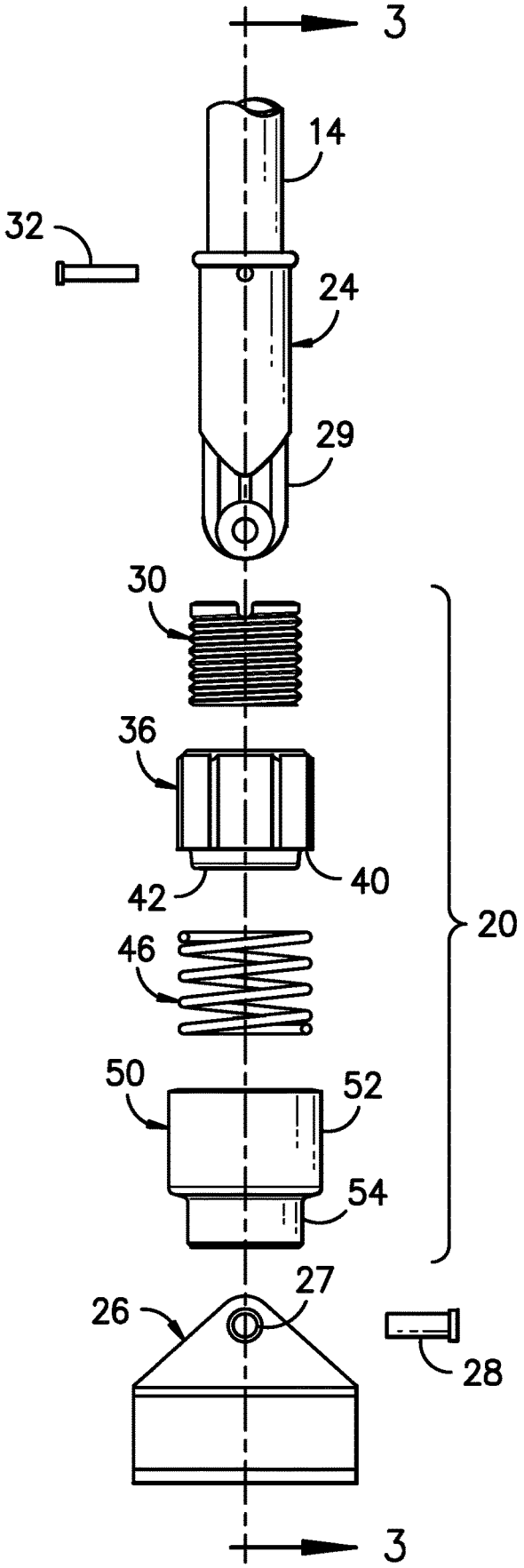
FIG. 2 is an exploded schematic view illustrating components of the attachment assembly and adjustable force applicator in the mop system of FIG. 1.
Figure 3:
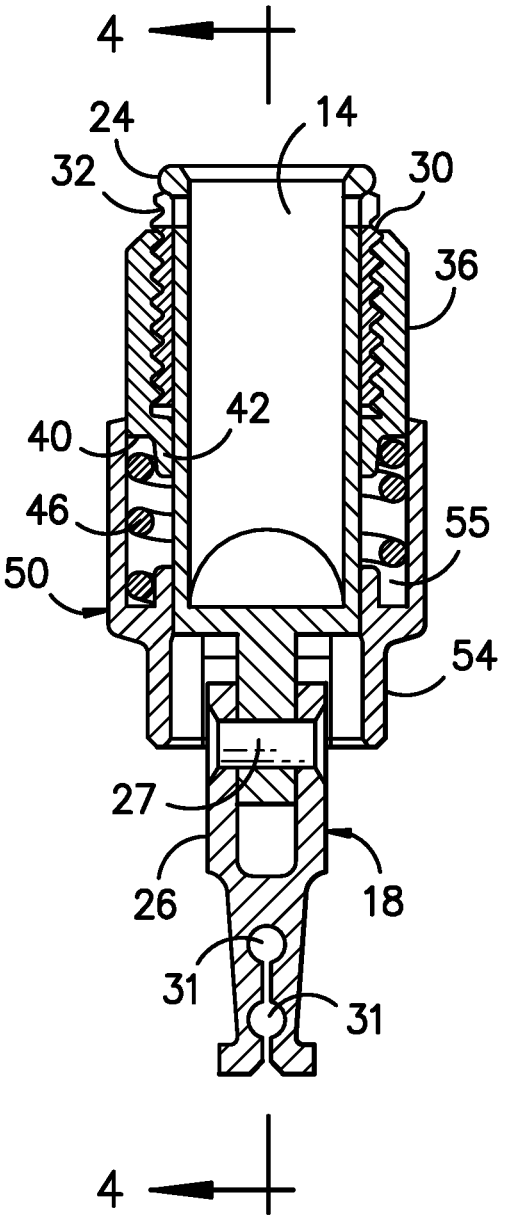
FIG. 3 is a cut-away schematic view illustrating components of the attachment assembly and adjustable force applicator in the mop system of FIG. 1 taken generally along axis line 3-3 in FIG. 2.
Figure 4:
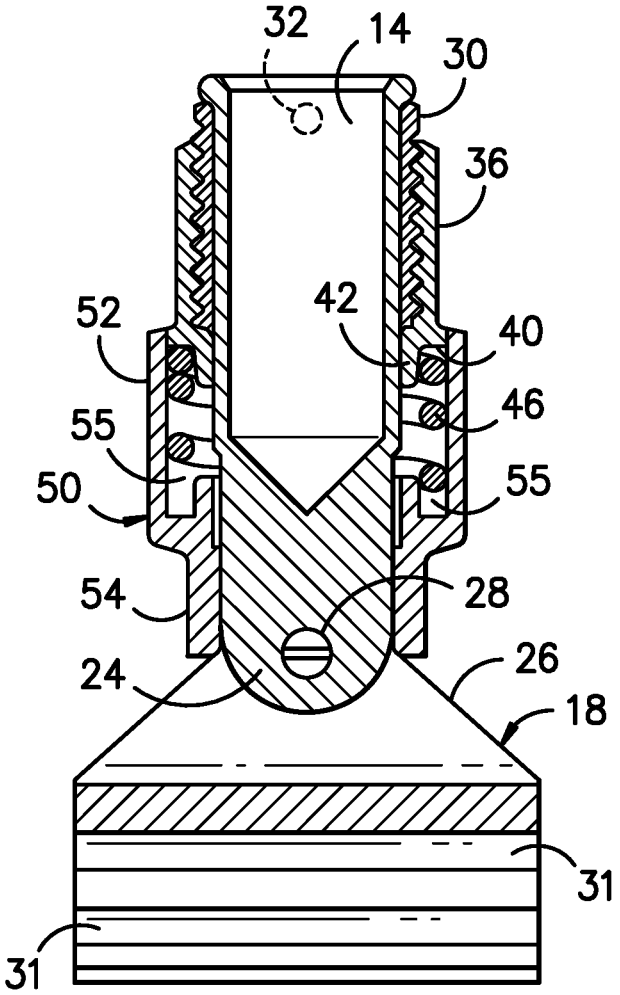
FIG. 4 is a cut-away schematic view illustrating components of the attachment assembly and adjustable force applicator in the mop system of FIG. 1 taken generally along axis line 4-4 in FIG. 3.

Referring now jointly to FIGS. 2-4, the individual elements of the mop system 10 above the mop frame are shown. As shown, in the illustrated exemplary construction, the frame attachment assembly designated generally by reference numeral 18 may include a handle attachment element 24 of resilient material disposed circumferentially around a distal end of the handle 14 and engaging a resilient connector head 26 at a pivot pin connection 27. As shown, the connector head 26 may have a split construction (best seen in FIG. 1) with a slot for receiving a downwardly projecting tongue 29 on the handle attachment element 24 in sandwiched relation.

As shown, the connector head 26 may generally have a pyramid shape with an opening for a pivot pin 28 at the apex between opposing sloped sides for connection to the downwardly projecting tongue 29 on the handle attachment element 24. Accordingly, in the exemplary mop system 10, the handle attachment element 24 and the connector head 26 cooperatively form the frame attachment assembly 18 such that the apex of the connector head 26 projects towards the handle 14. By way of example only, and not limitation, U.S. Pat. No. 7,574,777 to Fuller et al. (incorporated by reference) discloses such a frame attachment assembly.

Figure 1A:
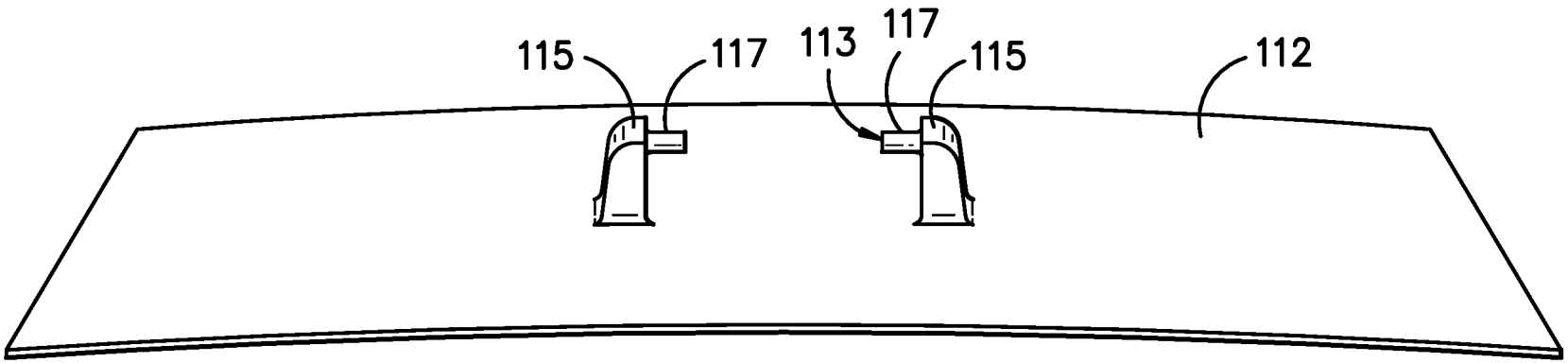
FIG. 1A illustrates an alternative mop frame for use in a mop system consistent with the present disclosure.

As best seen through joint reference to FIGS. 1, 1A and 3, the connector head 26 may include a plurality of interconnected, aligned engagement slots 31 adapted to engage and retain a mop head connection member 13 such that the mop head 12 may pivot around an axis defined by the mop head connection member during use. By way of example only and not limitation, one type of suitable connection member 13 may be in the form of bent wires having the shape of an inverted stirrup as shown in FIG. 1. Another type of connection member 113 as shown in FIG. 1A may be a pair of raised posts 115 with opposing inwardly projecting ears 117 for insertion and retention within the slots on opposite sides of the connector head 26. By way of example only, and not limitation, such raised posts may be integral with a mop head 112 of slightly bowed construction defining a concave lower surface having a plurality of hooking members (not shown) for engagement with a textile cleaning element. Of course, other connection members and mop head constructions may likewise be used if desired.

As noted previously, in the illustrated exemplary construction, an adjustable force applicator 20 is disposed in substantially co-axial relation to the handle 14 and operatively engages the frame attachment assembly 18 in the assembled condition. As shown, in the exemplary construction the adjustable force applicator 20 includes an internal threaded sleeve 30 which may be secured in substantially fixed relation to the handle 14 by an attachment pin 32 or other suitable technique to provide a stable connection between the handle and the internal threaded sleeve 30. As will be appreciated, in this arrangement, the internal threaded sleeve 30 will be substantially co-axial with the handle and is stationary such that it does not rotate or move axially.

In the exemplary construction, the adjustable force applicator 20 further includes an external threaded sleeve 36 adapted to engage the exterior of internal threaded sleeve 30 by threaded engagement such that the external threaded sleeve 36 may be screwed to different positions along the length of the internal threaded sleeve 30. Such adjustment between the internal threaded sleeve 30 and the external threaded sleeve 36 permits a free end of the external threaded sleeve 36 to extend to varying distances away from the internal threaded sleeve 30 and towards the connector head 26 in the assembled condition.

As best seen in FIGS. 3 and 4, the external threaded sleeve 36 includes a circumferential shoulder 40 positioned behind a reduced diameter circumferential nipple 42 defining the free end of the external threaded sleeve 36. As illustrated, the circumferential shoulder 40 defines a boundary for a compression spring 46 such that the reduced diameter nipple 42 is positioned at the interior of the compression spring 46. A free-floating pivot sleeve 50 is disposed in surrounding relation to the compression spring 46. In the illustrated exemplary construction, the pivot sleeve 50 is not physically attached to other components and is therefore free to move in tilting relation to the axis. As illustrated, the pivot sleeve 50 includes an enhanced diameter body 52 positioned above a reduced diameter pivot sleeve nipple 54. A circumferential groove 55 is positioned generally at the base of enhanced diameter body 52 to define a seating ledge for the end of the compression spring projecting away from external threaded sleeve 36. Thus, the compression spring 46 is captured between the circumferential shoulder 40 on the external threaded sleeve 36 and the seating ledge at the base of the circumferential groove 55.

As shown, in the assemble condition the apex of connector head 26 projects into the interior of the reduced diameter pivot sleeve nipple 54. In this regard, the reduced diameter pivot sleeve nipple 54 may include an arrangement of perimeter cut-outs adapted to receive the apex of connector head 26 in a desired orientation.

As will be appreciated, the described assembly permits a user to adjust the relative position of the internal threaded sleeve 30 and the external threaded sleeve 36 by screwing the external threaded sleeve towards or away from the connector head 26. This adjustment permits a user to substantially increase or decrease the stiffness of the pivot pin connection 27 in the frame attachment assembly 18. In this regard, as the external threaded sleeve 36 is screwed towards the connector head 26, the compression spring 46 will be compacted. This compression of the spring 46 increases the resistance force applied by the reduced diameter nipple 54 against the connector head 26 as it presses against the sloped edges of the connector head 26. As this resistance force is increased, the free movement of the swivel connection in the frame attachment assembly is decreased. Conversely, reducing this resistance force by screwing the external threaded sleeve 36 away from the connector head 26 will increase the free movement of the swivel connection. The compaction of compression spring 46 also provides a user with a feel for the degree of stiffness being imparted to the pivot pin connection 27 since the twisting force on the external threaded sleeve 36 will be proportional to the degree of compaction in the compression spring.

As will be appreciated, at low compression levels the compression spring 46 can be easily adjusted. However, greater force is required for corresponding adjustments at higher compression levels. Accordingly, in use, a partial compression of the compression spring 46 permits the mop head to swivel to some degree since the partial compaction of the compression spring still permits a degree of tilting movement by the pivot sleeve 50 back towards the handle. During such movement, the compression spring 46 is compressed further thereby biasing the pivot sleeve 50 back to the starting position. However, if the external threaded sleeve 36 is adjusted to fully compress the internal compression spring 46, the mop head will be substantially restricted against swivel movement since the pivot sleeve 50 will be restricted against any rearward sliding displacement. This substantial restriction is because the compression spring 46 is already fully compressed and therefor rearward movement of the floating pivot sleeve 50 cannot be accommodated. Of course, intermediate levels of spring compression may be applied as desired by simply screwing the external threaded sleeve to the desired position.

It is to be understood that variations and modifications of the foregoing are within the scope of the present disclosure. Thus, it is to be understood that the disclosure herein extends to all alternative combinations of two or more of the individual features mentioned or evident from the text and/or drawings. All of these different combinations constitute various alternative aspects of the present disclosure. The embodiments described herein explain the best modes known for practicing the disclosure and will enable others skilled in the art to utilize the disclosure. The claims are to be construed to include alternative embodiments and equivalents to the extent permitted by the prior art.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the disclosure (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Preferred embodiments of this disclosure are described herein, including the best mode known to the inventors for carrying out the disclosure. Variations of those preferred embodiments may become apparent to those of ordinary skill in the art upon reading the foregoing description. The inventors expect skilled artisans to employ such variations as appropriate, and the inventors intend for the disclosure to be practiced otherwise than as specifically described herein. Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

Various features of the disclosure are set forth in the following claims.

What is claimed is:

1. A cleaning tool comprising:

a mop head operatively connected to a handle assembly, the mop head including a connection member disposed at an upper surface of the mop head, the handle assembly comprising a frame attachment assembly adapted to engage and retain the connection member, the frame attachment assembly having a substantially pyramid shape including a base portion having one or more engagement slots adapted to engage the connection member and sloped sides extending upwardly in angled relation away from the base portion;

the handle assembly further comprising a handle attachment element operatively connected to one end of an elongated user manipulated handle having a length dimension, the handle attachment element including an integral tongue portion projecting axially away from the user manipulated handle along an axis corresponding to the handle length dimension, wherein the tongue portion is operatively connected to the frame attachment assembly at a position between the sloped sides and above the engagement slots; and an adjustable force applicator disposed circumferentially around the handle attachment element in coaxial relation to the user manipulated handle, the adjustable force applicator comprising an internal threaded sleeve secured in fixed, non-rotating relation to the user manipulated handle; an external threaded sleeve disposed in circumferential threaded relation to the internal threaded sleeve such that rotation of the external threaded sleeve causes axial movement of the external threaded sleeve relative to the internal threaded sleeve, the external threaded sleeve comprising a downwardly facing circumferential shoulder; a floating pivot sleeve disposed in circumferentially surrounding relation to a lower portion of the external threaded sleeve, the pivot sleeve including an axial opening adapted to receive an upper portion of the frame attachment assembly; and a spring seated between the downwardly facing circumferential shoulder of the external threaded sleeve and an opposing upward facing support surface at the interior of the pivot sleeve such that rotation of the external threaded sleeve causes adjustment to compression forces applied to the spring and the frame attachment assembly.

2. The cleaning tool as recited in claim 1, wherein the connection member disposed at an upper surface of the mop head comprises a bent wire with an inverted stirrup shape.

3. The cleaning tool as recited in claim 2, wherein the connection member disposed at an upper surface of the mop head comprises a pair of upwardly projecting posts with opposing ears projecting towards one another.

4. The cleaning tool as recited in claim 1, wherein the base portion of the frame attachment assembly includes two interconnected engagement slots.

5. The cleaning tool as recited in claim 1, wherein the sloped sides intersect to define a peaked apex projecting away from the base portion.

6. The cleaning tool as recited in claim 1, wherein the handle attachment element is held by friction circumferentially around said one end of the elongated user manipulated handle.

7. The cleaning tool as recited in claim 1, wherein the tongue is operatively connected to the frame attachment assembly by a pivot pin connection at a position between the sloped sides and above the engagement slots.

8. The cleaning tool as recited in claim 1, wherein the internal threaded sleeve is secured in fixed, non-rotating relation to the user manipulated handle by a pin connection.

9. The cleaning tool as recited in claim 1, wherein the pivot sleeve comprises a pivot sleeve body and a pivot sleeve nipple projecting downwardly away from the pivot sleeve body, the pivot sleeve nipple being coaxial with the pivot sleeve body and having an outer diameter less than the pivot sleeve body.

10. The cleaning tool as recited in claim 1, wherein the pivot sleeve is a one-piece structure free from connection to other elements.

11. The cleaning tool as recited in claim 1, wherein the pivot sleeve includes an interior circumferential groove having a base defining a support surface for the spring.

12. A cleaning tool comprising:

a mop head operatively connected to a handle assembly, the mop head including a connection member disposed at an upper surface of the mop head, the handle assembly comprising a frame attachment assembly adapted to engage and retain the connection member, the frame attachment assembly having a substantially pyramid shape including a base portion having one or more engagement slots adapted to engage the connection member and sloped sides extending upwardly in angled relation away from the base portion and towards one another;

the handle assembly further comprising a handle attachment element operatively connected to one end of an elongated user manipulated handle having a length dimension, the handle attachment element including an integral tongue portion projecting axially away from the user manipulated handle along an axis corresponding to the handle length dimension, wherein the tongue portion is operatively connected to the frame attachment assembly at a position between the sloped sides; and an adjustable force applicator disposed circumferentially around the handle attachment element in coaxial relation to the user manipulated handle, the adjustable force applicator comprising an internal threaded sleeve secured in fixed, non-rotating relation to the user manipulated handle; an external threaded sleeve disposed in circumferential threaded relation to the internal threaded sleeve such that rotation of the external threaded sleeve causes axial movement of the external threaded sleeve relative to the internal threaded sleeve, the external threaded sleeve comprising a main body portion and a nipple projecting downwardly away from the main body portion, the nipple having an outer diameter less than the main body portion to define a downwardly facing circumferential shoulder; a free-floating pivot sleeve disposed in circumferentially surrounding relation to a lower portion of the external threaded sleeve, the pivot sleeve comprising a pivot sleeve body and a pivot sleeve nipple projecting downwardly away from the pivot sleeve body, the pivot sleeve nipple being coaxial with the pivot sleeve body and having an outer diameter less than the pivot sleeve body, the pivot sleeve including a circumferential groove at the interior of the pivot sleeve and an axial opening adapted to receive an upper portion of the frame attachment assembly; and a spring seated between the downwardly facing circumferential shoulder of the external threaded sleeve and an opposing support surface within the circumferential groove at the interior of the pivot sleeve such that rotation of the external threaded sleeve causes adjustment to compression forces applied to the spring and the frame attachment assembly.

13. The cleaning tool as recited in claim 12, wherein the connection member disposed at an upper surface of the mop head has an inverted stirrup shape.

14. The cleaning tool as recited in claim 12, wherein the base portion of the frame attachment assembly includes two interconnected engagement slots.

15. The cleaning tool as recited in claim 12, wherein the sloped sides intersect to define a peaked apex projecting away from the base portion.

16. The cleaning tool as recited in claim 12, wherein the handle attachment element is held by friction circumferentially around said one end of the elongated user manipulated handle.

17. The cleaning tool as recited in claim 12, wherein the tongue is operatively connected to the frame attachment assembly by a pivot pin connection at a position between the sloped sides and above the engagement slots.

18. The cleaning tool as recited in claim 12, wherein the pivot sleeve is a one-piece structure free from connection to other elements.

* * * * *